US010363468B2

(12) United States Patent
Bergeron et al.

(10) Patent No.: US 10,363,468 B2
(45) Date of Patent: Jul. 30, 2019

(54) SPORTS SHAFT WITH STIFFENING BUMPER

(71) Applicant: SPORT MASKA INC., Montreal (CA)

(72) Inventors: Simon Bergeron, Montreal (CA); Travis Downing, Carlsbad, CA (US); Eric Allard, St-Hubert (CA); Jacques Chiasson, Laval (CA)

(73) Assignee: SPORT MASKA INC., Montreal, Quebec ( * ) Notice: Subject to any disclaimer, the term of this patent is extended or adjusted under 35 U.S.C. 154(b) by 0 days.

(21) Appl. No.: 15/484,437

(22) Filed: Apr. 11, 2017

(65) Prior Publication Data

US 2017/0296892 A1 Oct. 19, 2017

Related U.S. Application Data

(60) Provisional application No. 62/322,342, filed on Apr. 14, 2016.

(51) Int. Cl.

| | |
|---|---|
| ***A63B 59/70*** | (2015.01) |
| ***A63B 60/52*** | (2015.01) |
| ***A63B 60/54*** | (2015.01) |
| ***A63B 71/00*** | (2006.01) |

(52) U.S. Cl.

CPC ..... *A63B 59/70* (2015.10); *A63B 60/52* (2015.10); *A63B 60/54* (2015.10); *A63B 2071/009* (2013.01); *A63B 2209/02* (2013.01)

(58) Field of Classification Search

CPC ..... A63B 60/52; A63B 59/70; A63B 59/14; B29C 45/14

See application file for complete search history.

(56) References Cited

U.S. PATENT DOCUMENTS

| | | | | |
|---|---|---|---|---|
| 4,200,479 | A * | 4/1980 | Ardell | A63B 60/06 156/154 |
| 6,652,398 | B2 | 11/2003 | Falone et al. | |
| 6,837,812 | B2 | 1/2005 | Falone et al. | |
| 6,880,269 | B2 | 4/2005 | Falone et al. | |
| 6,935,973 | B2 | 8/2005 | Falone et al. | |
| 6,939,257 | B2 | 9/2005 | Tiitola | |
| 6,944,974 | B2 | 9/2005 | Falone et al. | |
| 7,171,696 | B2 | 2/2007 | Falone et al. | |
| 7,201,678 | B2 | 4/2007 | Filice et al. | |
| 8,047,935 | B2 | 11/2011 | Sugaya | |
| 8,052,551 | B2 | 11/2011 | Blotteaux et al. | |
| 8,747,261 | B2 * | 6/2014 | McGuire, Jr. | B29C 70/088 473/513 |

(Continued)

*Primary Examiner* — Michael D Dennis

(74) *Attorney, Agent, or Firm* — Norton Rose Fulbright Canada

(57) ABSTRACT

A sports shaft having an elongated body having a perimeter defined by a plurality of main walls with adjacent ones of the main walls being interconnected through a corresponding one of a plurality of edge walls, the edge walls being spaced apart around the perimeter. A respective bumper extends along at least part of length of at least one of the edge walls. The main and edge walls without the respective bumper have a first stiffness along a longitudinal direction of the shaft, and a combination of the respective bumper with the at least one of the edge walls has a stiffness along the longitudinal direction greater than the first stiffness. A method of making a sports shaft is also discussed.

11 Claims, 7 Drawing Sheets

(56) References Cited

U.S. PATENT DOCUMENTS

| | | | | |
|---|---|---|---|---|
| 9,265,999 | B2 | 2/2016 | Vito et al. | |
| 9,283,454 | B2 | 3/2016 | Bond | |
| 2002/0037780 | A1* | 3/2002 | York | A63B 59/70 473/560 |
| 2010/0323830 | A1* | 12/2010 | Blotteaux | A63B 49/14 473/563 |
| 2012/0190473 | A1* | 7/2012 | Swist | A63B 49/02 473/282 |

* cited by examiner

SPORTS SHAFT WITH STIFFENING BUMPER

CROSS-REFERENCE TO RELATED APPLICATIONS

This application claims priority from U.S. provisional application No. 62/322,342 filed Apr. 14, 2016, the entire contents of which are incorporated by reference herein.

TECHNICAL FIELD

The application relates generally to sports equipment and, more particularly, to sports shaft for elongated sports equipment such as hockey sticks.

BACKGROUND OF THE ART

Sports equipment having an elongated shaft, such as hockey sticks, must typically be able to withstand a large number of impacts, particularly along the edges of the shaft which are typically more susceptible to damage during play.

The shaft is additionally subjected to significant stresses due to manipulation during play, including bending stresses, which can lead to damage of some known edge protectors.

SUMMARY

In one aspect, there is provided a sports shaft comprising: an elongated body having a perimeter defined by a plurality of main walls with adjacent ones of the main walls being interconnected through a corresponding one of a plurality of edge walls, the edge walls being spaced apart around the perimeter; a respective bumper extending along at least part of length of at least one of the edge walls; wherein the main and edge walls without the respective bumper have a first stiffness along a longitudinal direction of the shaft; and wherein a combination of the respective bumper with the at least one of the edge walls has a second stiffness along the longitudinal direction which is greater than the first stiffness.

In another aspect, there is provided a method of making a sports shaft, the method comprising: forming at least one elongated bumper in a cured state; surrounding an expandable mandrel with layers of uncured material; placing the surrounded mandrel in a female mold with the at least one elongated bumper extending along a respective edge wall of the shaft; and curing the uncured material by heating and pressing the uncured material against mold surfaces of the female mold with the mandrel to produce the sports shaft.

DESCRIPTION OF THE DRAWINGS

Reference is now made to the accompanying figures in which.

DETAILED DESCRIPTION

Figure 1:
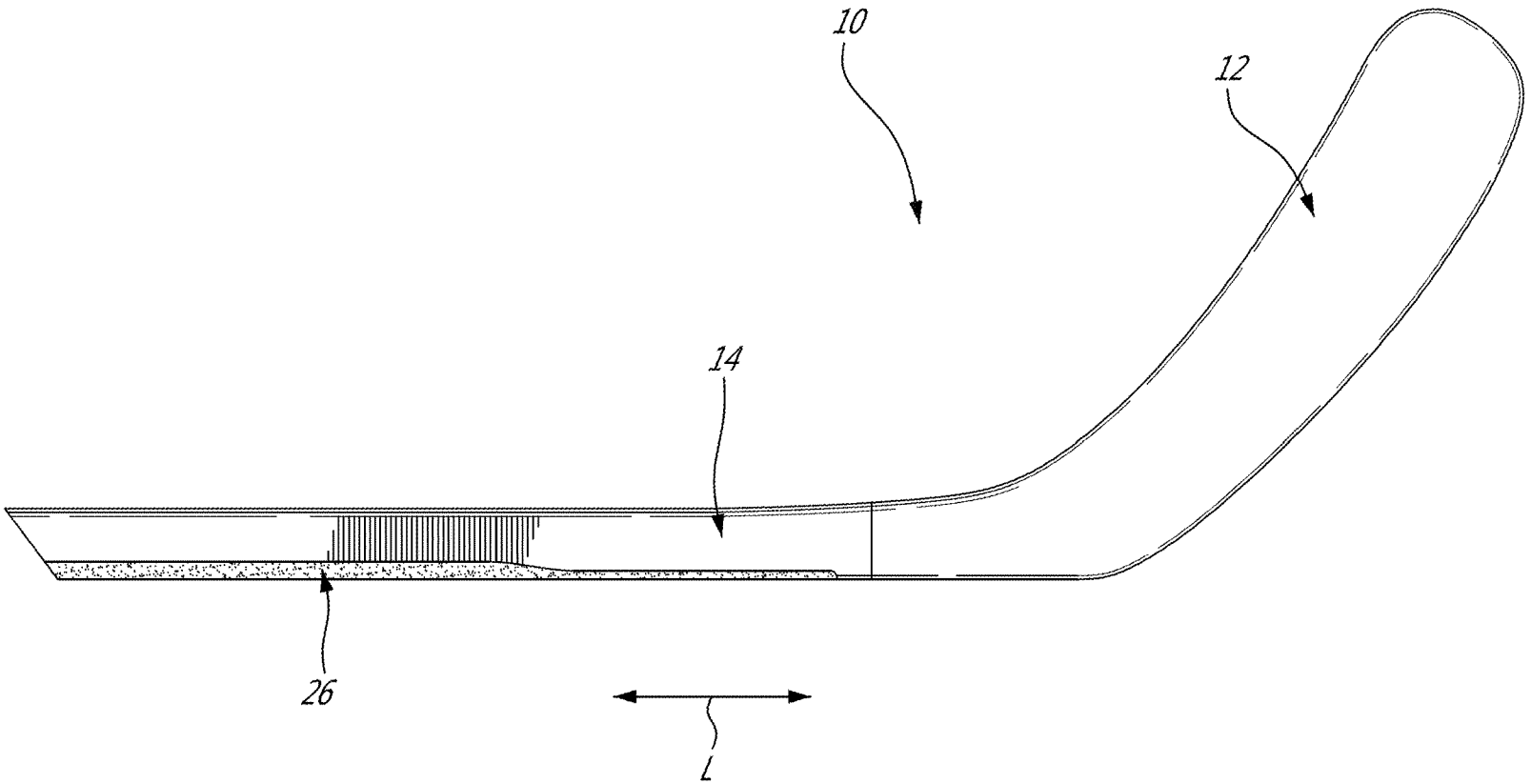
FIG. 1 is a schematic side view of part of a hockey stick according to a particular embodiment.

Referring to FIG. 1, part of an elongated sports equipment including a shaft is shown, which in this embodiment is a hockey stick 10 generally including a blade 12 having the shaft 14 extending from one end thereof. It is understood that alternately the elongated sports equipment may be any suitable type of equipment having a shaft, including, but not limited to, ice hockey stick, field hockey stick, floor, dek or street hockey stick, lacrosse stick, ringuette stick, etc.

Figure 2:
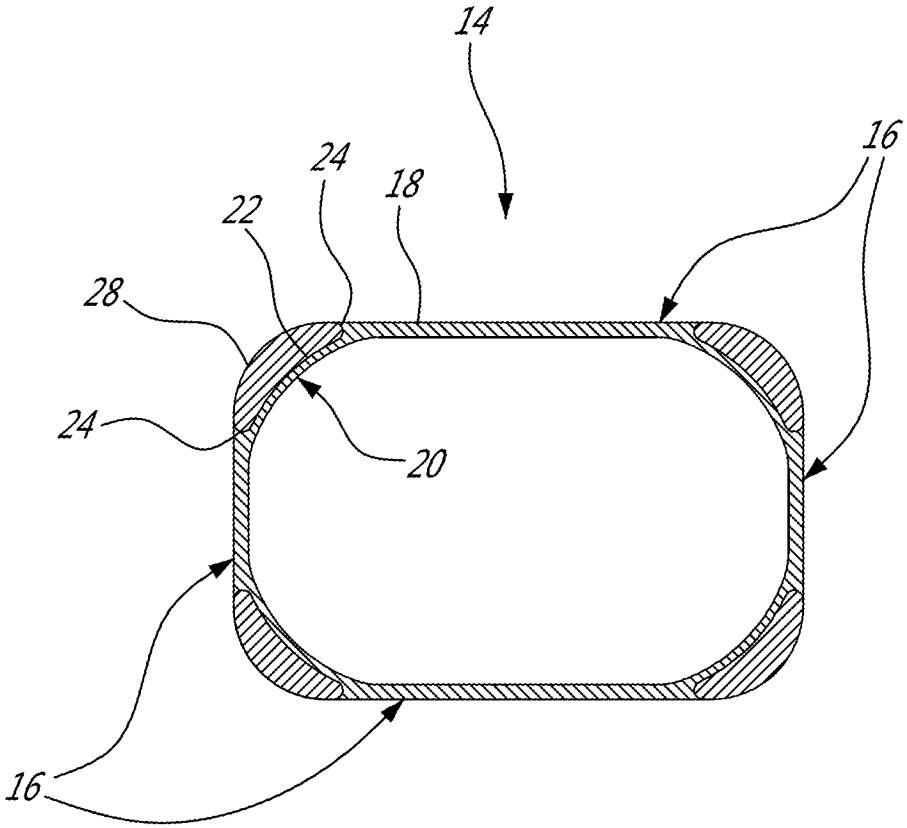
FIG. 2 is a schematic cross-sectional view of a shaft of the hockey stick of FIG. 1, according to a particular embodiment.
Figure 3:
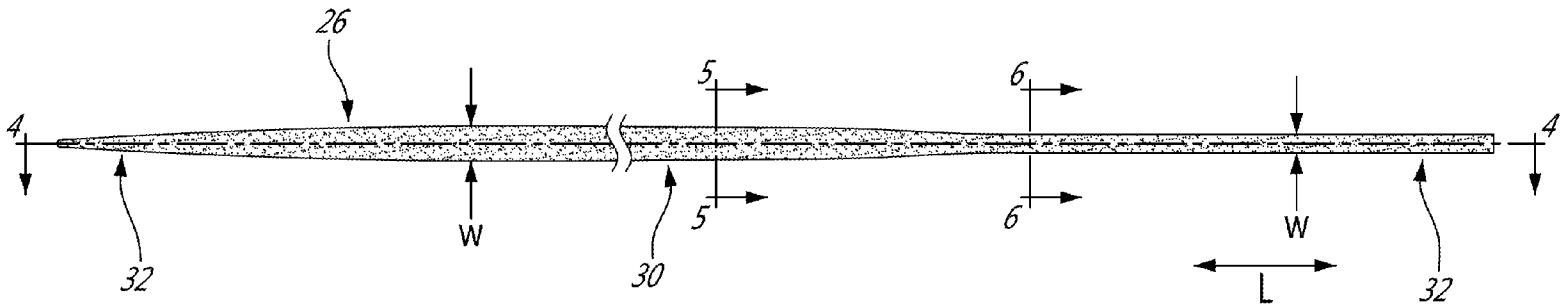
FIG. 3 is a schematic, broken side view of a bumper of the shaft of the hockey stick of FIG. 1, according to another particular embodiment.
Figure 4:
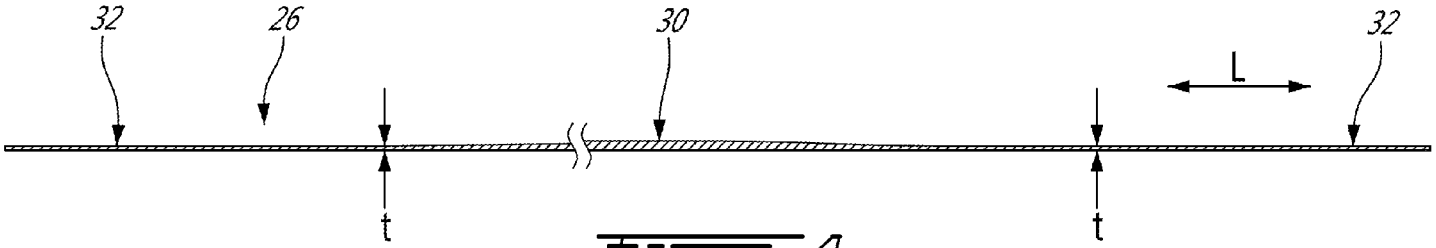
FIG. 4 is a schematic cross-sectional view of the bumper of FIG. 3, taken along lines 4-4.
Figure 5:
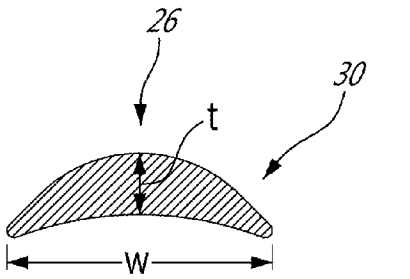
FIG. 5 is a schematic cross-sectional view of the bumper of FIG. 3, taken along lines 5-5.

Referring to FIG. 2, the shaft 14 is generally defined by a plurality of interconnected elongated main walls 16; in the particular embodiments shown and described therein, two pairs of parallel or substantially parallel main walls 16 are provided, with the two pairs extending perpendicularly or substantially perpendicularly from each other, so that the shaft 14 has a rectangular cross-sectional shape.

The shaft 14 is generally hollow, and the adjacent main walls 16 are interconnected by elongated edge walls 20, which may have a smaller width than the main walls 16, and are spaced around the perimeter of the shaft 14. In the embodiment shown, the edge walls 20 each define a flat or slightly convex outer surface 22 extending at approximately 45 degrees from each of the two interconnected main walls 16, and connected to each main wall 16 by a respective elongated shoulder 24, such that each edge wall 20 defines a recess or groove in the outer perimeter of the shaft 14; other configurations are possible, some of which will be further described below.

Each edge wall 20 includes a respective elongated stiffening bumper 26 which extends along at least part of the length of the edge wall 20 and of the shaft 14 (only one bumper 26 being shown in FIG. 1). In the embodiment shown, each edge wall 20 is covered, in whole or in part, by the respective bumper 26, and an outer surface 28 of the bumpers 26 extends continuously with the outer surface 18 of the adjacent main walls 16. It is understood that alternately, the bumper 26 may extend within the edge wall 20, whether completely embedded therein so that the edge wall 20 defines outer and inner surfaces with the bumper 26 extending therebetween, or located such that an inner surface of the bumper 26 is exposed in the internal cavity of the hollow shaft 14.

Figure 6:
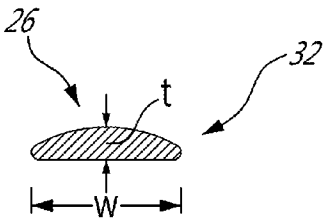
FIG. 6 is a schematic cross-sectional view of the bumper of FIG. 3, taken along lines 6-6.

Referring to FIGS. 1 and 3-6, in a particular embodiment, the cross-section of each bumper 26 varies along the longitudinal direction L, i.e. along the length of the shaft 14. In the embodiment shown, the cross-section of the bumper 26 varies both in width w and in thickness t, which are both greater along an intermediate longitudinal portion 30 (FIG. 5) of the bumper 26 than at its extremities 32 (FIG. 6). Alternately, the bumper 26 may have a constant width w and/or thickness t along its length.

Although the main walls 16 are shown with a flat outer surface 18, and with a clear transition between the main walls 16 and the edge walls 20, it is understood that alternately the main walls 16 and/or edge walls 20 may have a concave or convex outer surface 18. It is understood that other cross-sectional shapes and/or a different number of main walls are also possible, including, but not limited to, non-parallel and non-perpendicular walls, and/or semi-circular, hexagonal and octagonal cross-sectional shapes.

Although not shown, one or more additional layers of material may be applied over the main walls 16 and bumpers 26, for example a cosmetic layer of paint and/or decals providing a desired visual aspect for the shaft 14, which may be overlaid by a transparent coating, for example to provide wear protection. Accordingly, the bumpers 26 may not be visible in use even when they are engaged to an outer surface of the edge walls 20.

The combination of each bumper 26 with its associated edge wall 20 has a stiffness along the longitudinal direction L of the shaft 14 which is greater than that of the main and edge walls 16, 20 of the shaft 14. Although the bumper 26 may be made of material less stiff than that of the main and edge walls 16, 20, in a particular embodiment, each bumper 26 alone has a stiffness along the longitudinal direction L of the shaft 14 which is greater than that of the main and edge walls 16, 20 of the shaft 14.

The bumpers 26 form a reinforcement structure (e.g. external reinforcement structure in the embodiment shown) for the shaft 14, providing reinforcement at least along the longitudinal direction L. Accordingly, the bumpers 26 add protection to the edge walls 20 of the shaft 14, while also contributing to adding stiffness to the shaft 14 along these edge walls 20, which in particular embodiment allows to improve the performance of the stick 10.

In a particular embodiment, the presence of the bumpers 26 provides for an increased resistance in bending of the shaft 14, as compared with a similar shaft without bumpers. In a particular embodiment, the bumpers 26 have a higher impact toughness than the main and edge walls 16, 20 of the shaft 14.

In a particular embodiment, the difference in stiffness between the bumpers 26 and the main and edge walls 16, 20 is obtained by having the bumpers 26 made from a different material than that of the main and edge walls 16, 20. The material of the bumpers 26 may also have a greater hardness than that of the material of the main and edge walls 16, 20.

In a particular embodiment, the bumpers 26 and walls 16, 20 are all made of composite material including reinforcing fibers, with the bumpers 26 including a greater proportion of fibers oriented along the longitudinal direction L than the walls 16, 20. In one example of shaft configuration, the walls 16, 20 are made from laminated layers of pre-preg materials having reinforcing fibers extending in multiple directions, for example non-woven fibers, or woven fibers extending non-parallel to the longitudinal direction L, with optionally having some of the fibers extending along the longitudinal direction L, and the bumpers 26 are made from fiber-reinforced material where all of the fibers extend along the longitudinal direction L. Other configurations are also possible.

The bumpers 26 and walls 16, 20 made of composite material with differently oriented fibers may be made of the same composite material, or of different composite materials. For example, in a particular embodiment, the walls 16, 20 are made of a carbon fiber/epoxy composite material, while the bumpers 26 are made of an aramid fiber/epoxy composite material. Any other suitable types of fibers may be used in the bumpers 26 including, but not limited to, carbon and glass fibers, in combination with walls 16, 20 including reinforcing fibers or with walls 16, 20 made of any other suitable type of material.

In a particular embodiment, applicable but not limited to carbon fibers in the walls 16, 20 and aramid fibers in the bumpers 26, the fibers of the bumper 26 have a higher elongation at failure than the fibers of the walls 16, 20; the fibers of the bumper 26 are more ductile and accordingly have a higher impact toughness than the fibers of the walls 16, 20. When fibers made of different materials are used in the bumpers 26 and walls 16, 20, the fibers in the bumpers 26 and walls 16, 20 may have a similar orientation, providing the difference in material provides sufficient increased stiffness for the edge walls 20 containing the bumpers 26.

Other suitable materials for the bumpers 26 include any appropriate material sufficiently rigid such as to be amorphous and not flow under impact suffered during normal use of the shaft 14. Examples of suitable materials include, but are not limited to, metal such as aluminium, bamboo or other suitable wood, suitable plastics, suitable thermoplastic fibers such as polypropylene fiber (e.g. Innegra™) and polyethylene fiber (e.g. Dyneema™). In a particular embodiment, the bumpers 26 are made of non-elastomeric material.

Figure 7:
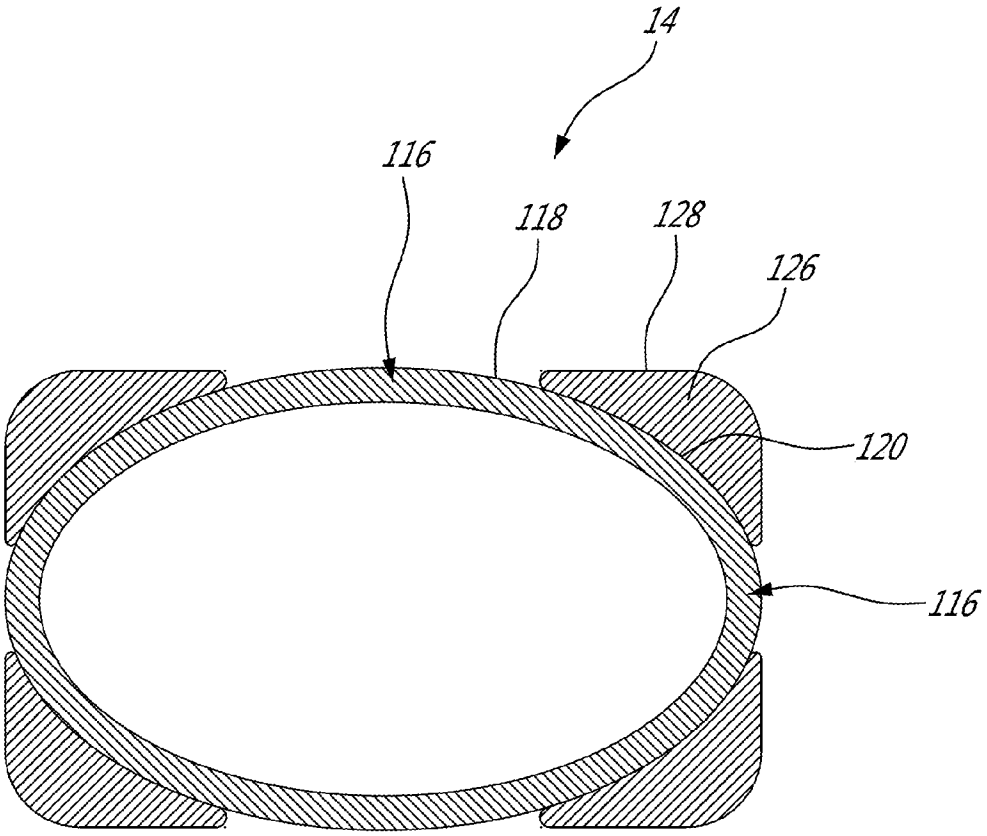
FIG. 7 is a schematic cross-sectional view of a shaft of the hockey stick of FIG. 1, according to another particular embodiment.

Referring to FIG. 7, an alternate configuration for the shaft 14 is shown. In this embodiment, the main walls 116 and edge walls 120 are connected in a continuous manner so as to cooperate to define a continuous cross-sectional shape, such as the oval cross-sectional shape shown. In this embodiment, bumpers 126 are received on the outer surface of the edge walls 120, and the outer surface 128 of the bumpers 126 extends continuously or substantially continuously with the outer surface 118 of the adjacent main walls 116, so as to form a rectangular or substantially rectangular outer cross-sectional shape for the shaft 14. The walls 116, 120 and bumpers 126 may have similar materials and properties as the respective walls 16, 20 and bumpers 26 described above.

Figure 8:
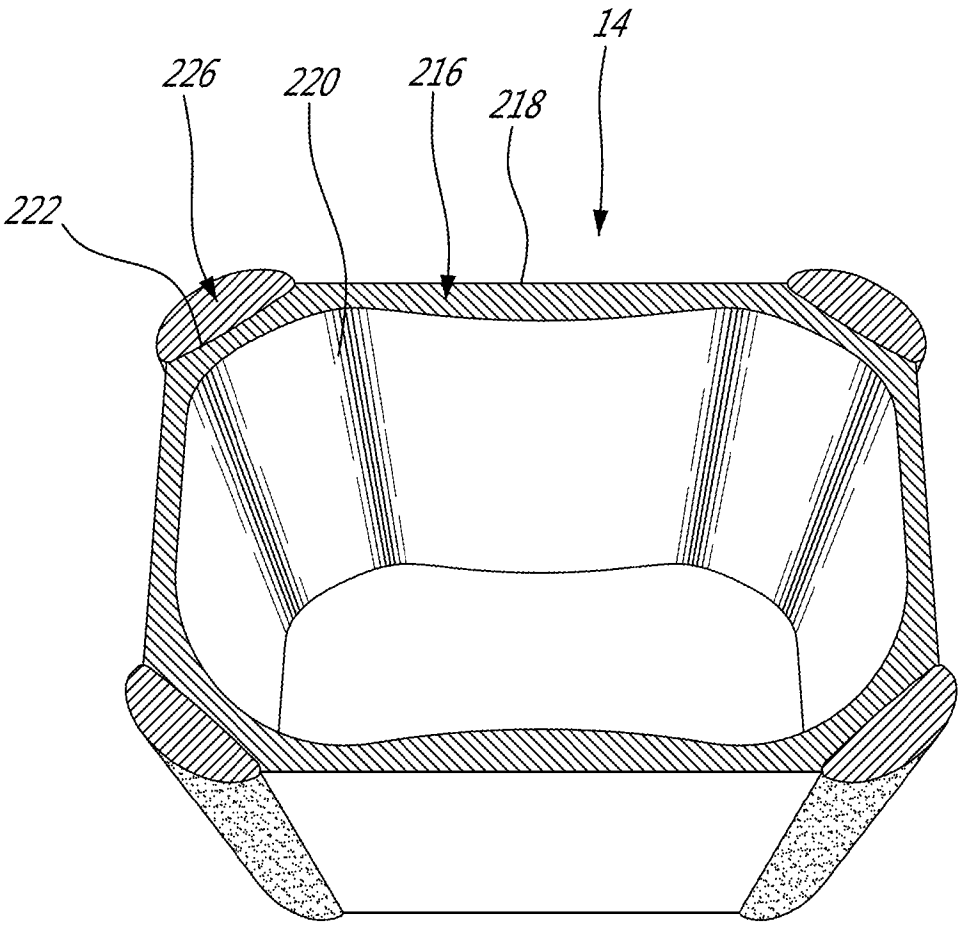
FIG. 8 is a schematic tridimensional view of a part of the shaft of the hockey stick of FIG. 1, according to another particular embodiment.

Referring to FIG. 8, another alternate configuration for the shaft 14 is shown. In this embodiment, the outer surface of the bumpers 226 is non-continuous with the outer surface 218 of the adjacent main walls 216; the bumpers 226 protrude outwardly from the outer surface 218 of the adjacent main walls 216, such that each bumper 226 forms an outward bulge with respect to a cross-sectional shaft area defined by the outer surface 218 of the main walls 216. The shoulders are omitted from the edge wall 220, such that the outer surface 222 of the edge wall 220 is directly connected to the outer surface 218 of the main wall 216. The walls 216, 220 and bumpers 226 may have similar materials and properties as the respective walls 16, 20 and bumpers 26 described above.

It is understood that any configuration of edge walls 20, 120, 220 of FIGS. 2, 7 and 8 may be combined with any configuration of bumper 26, 126, 226 of FIGS. 2, 7 and 8.

Figure 9:
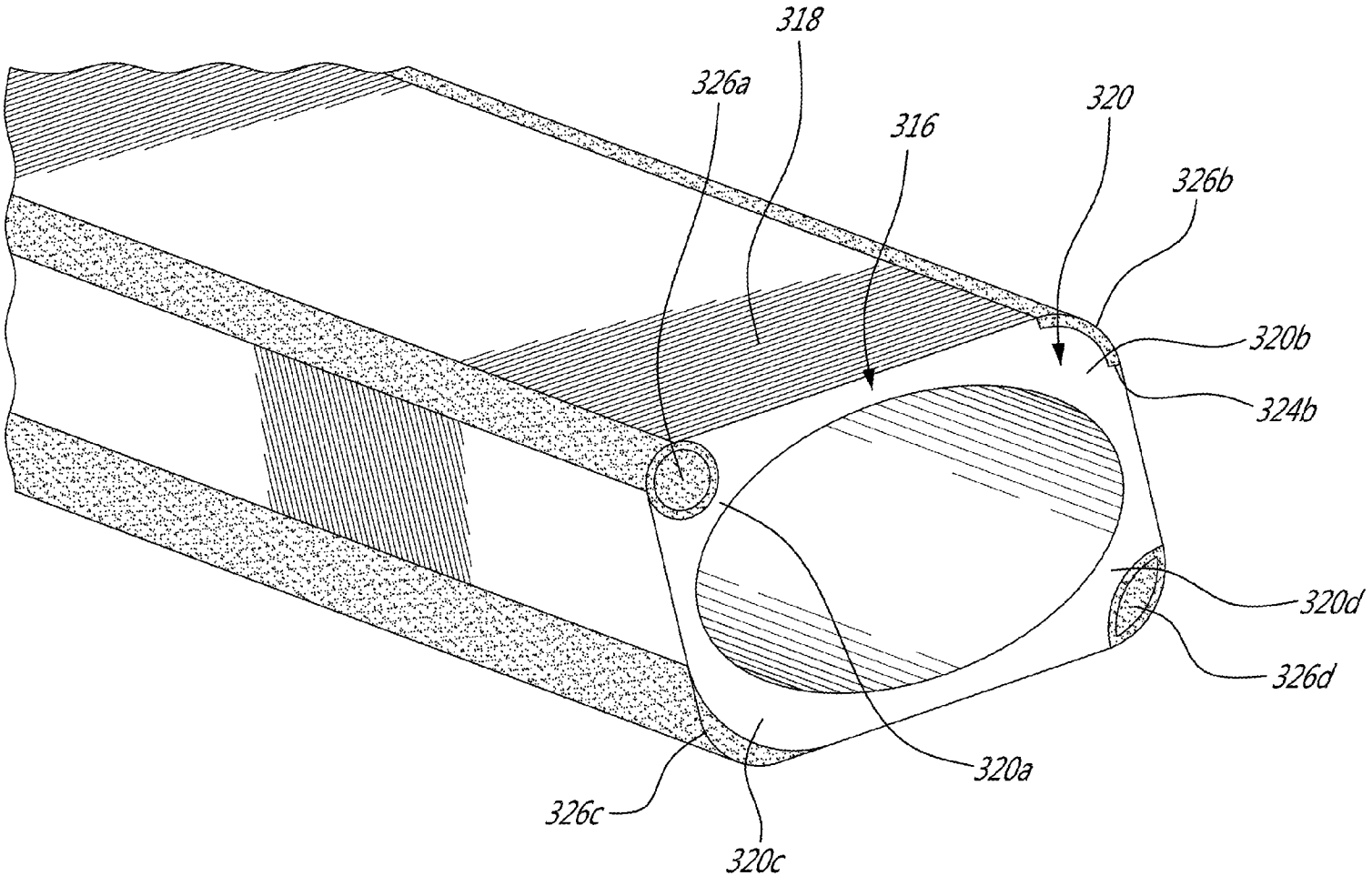
FIG. 9 is a schematic tridimensional view of part of the shaft of the hockey stick of FIG. 1, showing bumpers according to various particular embodiments.

In the embodiments shown above, the bumper 26, 126, 226 has a crescent-shaped cross-section; however, it is understood that any other suitable cross-section shape may be used. FIG. 9 shows examples of suitable cross-sectional shapes. The different bumper shapes are shown as applied to a same shaft; it is understood that all the bumpers of the shaft may have a similar shape, and that alternately, two or more of the bumpers of the same shaft may have different shapes from one another (for example, the shaft may include two pairs of similar bumpers with the bumpers of different pairs having different shapes).

In one embodiment, the edge wall 320*a* is defined as a concave arc extending around an included angle of more than 180 degrees. The bumper 326*a* has a circular, hollow cross-section and is received in the groove defined by the concave edge wall 320*a*. Alternately, the bumper 326*a* may be a solid bumper, i.e. without the hollow center shown.

In another embodiment, the edge wall 320*b* is defined as a convex arc connected to each adjacent main wall 316 by a shoulder 324*b*. The bumper 326*b* has a c-shaped cross-section of constant thickness and is received against the convex arc of the edge wall 320*b*, in abutment with and between the shoulders 324*b*.

In another embodiment, the edge wall 320*c* is defined as a convex arc directly connected to the adjacent main walls 316 to form a continuous surface therewith, i.e. without shoulders therebetween. The bumper 326*c* has a c-shaped cross-section and is received against the convex arc of the edge wall 320*c*. The bumper 326*c* has tapered ends at the junction with the adjacent main walls 316 such that the outer surface of the bumper 326*c* is continuous with the outer surface of the main walls 316.

In another embodiment, the edge wall 320*d* is defined as a concave arc extending around an included angle of less than 180 degrees. The bumper 326*d* has a hollow, leaf-shaped cross-section (elliptical shape with pointed ends) and is received in the groove defined by the concave edge wall 320*d*. Alternately, the bumper 326*d* may be a solid bumper, i.e. without the hollow center shown.

All the bumpers 326*a-d* of FIG. 9 are shown as having an outer surface which extends continuously with the outer surface 318 of the adjacent main walls 316. Alternately, any of the bumpers 326*a-d* shown may have an outer surface which is non-continuous with the outer surface 318 of the adjacent main walls 316; the bumper 326*a-d* may protrude outwardly from the outer surface 318 of the adjacent main walls 316 such as to form an outward bulge with respect to the cross-sectional shaft area defined by the outer surface 318 of the main walls 316. The walls 316, 320 and bumpers 326*a-d* may have similar materials and properties as the respective walls 16, 20 and bumpers 26 described above.

It is understood that any other suitable solid or hollow cross-sectional shape can alternately be used for the bumpers. Each edge wall may have an outer surface defined by a single planar or curved surface, or by a plurality of interconnected planar or curved surfaces.

Although the shaft 14 has been shown with a bumper covering each of its edge walls, it is understood that alternately, only one or some of the edge walls may be provided with (e.g. covered with) a respective bumper.

In a particular embodiment, the bumpers 26, 126, 226, 326*a-d* are formed separately from the main and edge walls of the shaft 14 and, if made from a material necessitating curing, cured before being assembled to the walls of the shaft. In a particular embodiment where the walls of the shaft are made from a material necessitating curing, the cured bumpers are positioned on the uncured walls, and the walls are cured and bonded to the bumpers during curing, in a co-curing operation. Alternately, the walls of the shaft and the bumpers may be separately cured, and then bonded together in a subsequent operation.

In a particular embodiment where the bumpers are in composite material, the bumpers are made by pultrusion with the reinforcing fibers all oriented longitudinally, and optionally machined after pultrusion if a variable width and/or thickness is required along the length of the bumpers, such as shown for example in FIGS. 3-6. Alternately, the bumpers may be molded, directly to the desired shape or into an intermediate shape which may be machined as required.

Figure 10:
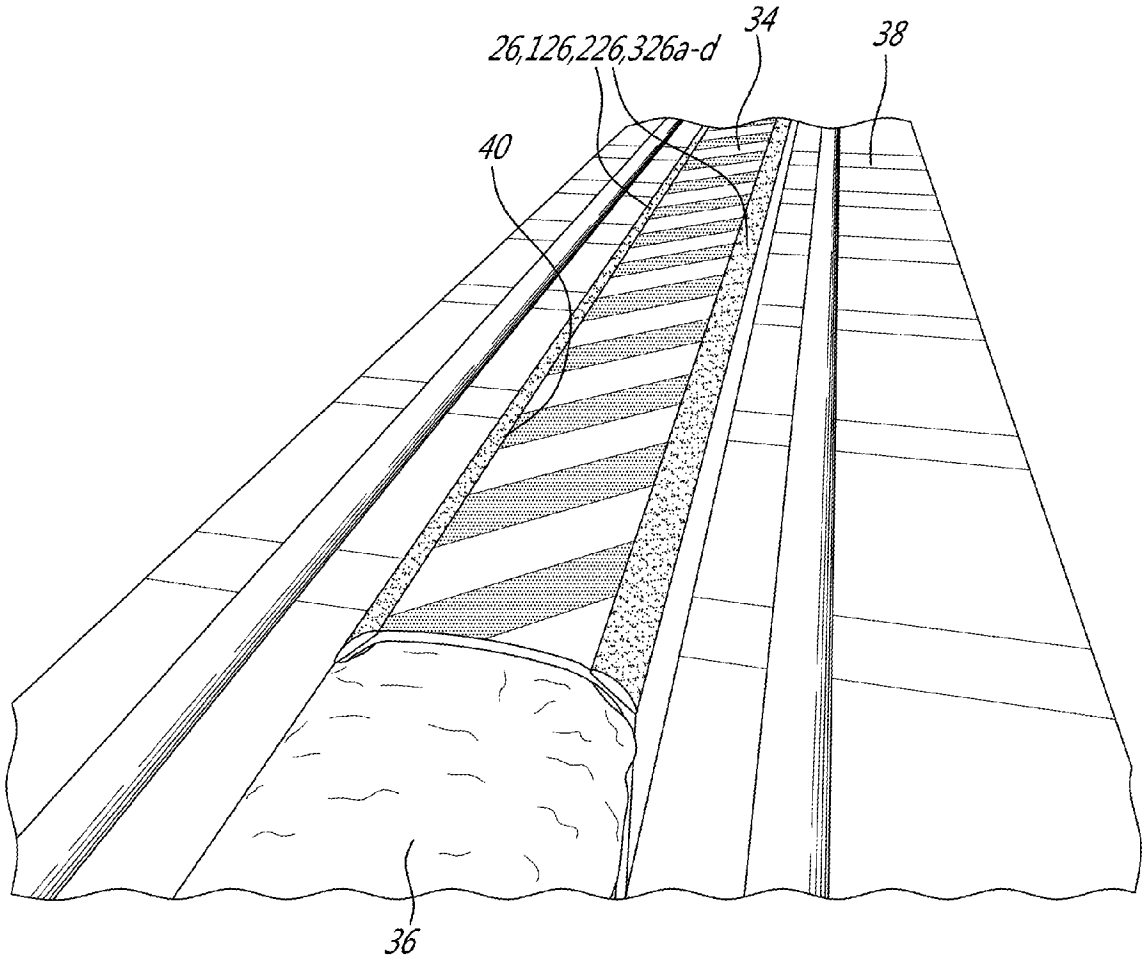
FIG. 10 is a tridimensional view of a step of a molding process of the shaft of the hockey stick of FIG. 1, according to a particular embodiment.

Referring to FIG. 10, in a particular embodiment the shaft 14 is formed by a compression or bladder molding method. Layers of uncured pre-preg material 34 are assembled around an expandable mandrel 36 to define the shaft 14. The mandrel 36 is placed in a female mold 38 (only part of which is shown), with the cured bumpers 26, 126, 226, 326*a-d* being each disposed over the location of the respective edge wall. Adhesive may be provided between the bumpers and uncured material 34 of the shaft, and/or lightweight scrim may be used to hold the number in place on the shaft pre-form defined by the uncured material. Alternately, the bumpers could be disposed over their respective location by being retained in the mold cavities.

If the bumpers are intended to be contained within the edge wall, one or more additional layer(s) of pre-preg material 34 may be wrapped around the bumpers and shaft after the bumpers are disposed over the location of the respective edge wall.

The mold 38 is closed, and the expandable mandrel 36 is expanded while heating the assembly to press the uncured material 34 against the mold surfaces 40 (only partially shown) of the female mold 38 to cure the material of the walls of the shaft 14. The pressure of the uncured material against the mold surfaces 40 forms a close contact between the bumpers 26, 126, 226, 326*a-d* and the material of the walls; in some embodiments, the bumpers are partially or completely embedded in the walls. The bumpers, for example located intermediate the mold surface 40 and the material of the shaft 14, shape the edge walls, with the pressure of the expandable mandrel 36 pressing the material 34 against and around the bumpers.

In a particular embodiment, the expandable mandrel 36 is a bladder, which is expanded to press the material 34 against the mold surfaces 40 by inflation. In another embodiment, the expandable mandrel 36 is made of thermally expandable material, which is thermally expanded to press the material 34 against the mold surfaces 40. Suitable thermally expandable materials include, but are not limited to, silicone.

In a particular embodiment, the presence of the bumper(s) advantageously allows to modify the stiffness properties of the overall shaft by changing the way the material is distributed around the perimeter of the shaft. The added stiffness in the "corners" (edge walls) provide for a rigidity adjustment, increase of impact toughness and/or increase in bending strength as compared to a similar shaft without bumpers.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A sports shaft comprising:

an elongated body having a perimeter defined by four main walls defining a rectangular cross-section and interconnected through four edge walls, the edge walls being spaced apart around the perimeter;

a respective bumper covering and extending along at least part of a length of the edge walls, a cross-sectional area of the respective bumper being less than or equal to that of the elongated body, and the respective bumper having a crescent cross-sectional shape;

wherein the main and edge walls without the respective bumper have a first stiffness along the at least part of the length of the at least one of the edge walls;

wherein a combination of the respective bumper with the at least one of the edge walls has a second stiffness along the at least part of the length of the at least one of the edge walls which is greater than the first stiffness; and wherein the respective bumper has a stiffness along the at least part of the length of the at least one of the edge walls which is greater than the first stiffness.

2. The sports shaft as defined in claim 1, wherein the elongated body is hollow.

3. The sports shaft as defined in claim 1, wherein a cross-section of the respective bumper varies along a length of the shaft.

4. The sports shaft as defined in claim 1, wherein the respective bumper is made of a material different from that of the main and edge walls.

5. The sports shaft as defined in claim 4, wherein the material of the respective bumper has a greater hardness than that of the main and edge walls.

6. The sports shaft as defined in claim 4, wherein the material of the respective bumper has a greater impact toughness than that of the main and edge walls.

7. The sports shaft as defined in claim 1, wherein the respective bumper includes reinforcing fibers, all of the reinforcing fibers of the respective bumper extending along a longitudinal direction of the shaft.

8. The sports shaft as defined in claim 7, wherein the main and edge walls include reinforcing fibers non-parallel to the longitudinal direction.

9. The sports shaft as defined in claim 1, wherein the respective bumper extends along an outer surface of the at least one of the edge walls.

10. The sports shaft as defined in claim 1, wherein the respective bumper is made of non-elastomeric material.

11. A hockey stick comprising a blade and the sports shaft of claim 1 connected to one end of the blade.

* * * * *